US006316712B1

(12) United States Patent
Laroche

(10) Patent No.: US 6,316,712 B1
(45) Date of Patent: Nov. 13, 2001

(54) METHOD AND APPARATUS FOR TEMPO AND DOWNBEAT DETECTION AND ALTERATION OF RHYTHM IN A MUSICAL SEGMENT

(75) Inventor: Jean Laroche, Santa Cruz, CA (US)

(73) Assignee: Creative Technology Ltd., Singapore (SG)

( * ) Notice: Subject to any disclaimer, the term of this patent is extended or adjusted under 35 U.S.C. 154(b) by 0 days.

(21) Appl. No.: 09/378,279

(22) Filed: Aug. 20, 1999

Related U.S. Application Data

(60) Provisional application No. 60/117,154, filed on Jan. 25, 1999.

(51) Int. Cl.[7] ..... G10H 1/40
(52) U.S. Cl. ..... 84/636; 84/DIG. 12
(58) Field of Search ..... 84/611, 612, 635, 84/636, 639–643, DIG. 12, DIG. 29

(56) References Cited

U.S. PATENT DOCUMENTS 4,419,918 * 12/1983 Dyck et al. ..... 84/DIG. 12
4,694,724 * 9/1987 Kikumoto et al. ..... 84/DIG. 29
5,256,832 * 10/1993 Miyake ..... 84/636
5,270,477 * 12/1993 Kawashima ..... 84/636 X
5,453,570 * 9/1995 Umeda et al. ..... 84/636
5,585,586 * 12/1996 Wakuda ..... 84/636
5,973,255 * 10/1999 Tanji ..... 84/636

OTHER PUBLICATIONS

"Determination of the meter of musicl scores by autocorelation," Brown, *J. Acoust. Soc. Am.* 94 (4) Oct. 1993.
"Tempo and beat analysis of acoustic musical signals," Scheirer, *J. Acoust. Soc. Am.*, 103 (1) Jan. 1998.
"Pulse Tracking with a Pitch Tracker," Scheirer, Machine Listening Group, MIT Media Laboratory, Cambridge, MA 02139, 1997.

* cited by examiner

*Primary Examiner*—Stanley J. Witkowski
(74) *Attorney, Agent, or Firm*—Townsend and Townsend and Crew LLP

(57) ABSTRACT

An apparatus and method for determining the tempo and locating the downbeats of music encoded by an audio track performs a cross-correlation between a click track and a pulse track to indicate tempo candidates and between the click track and a series of pulses to determine downbeat candidates. The rhythm of the track is modified by altering segments located between the beats before playback. Swing is added by lengthening and shortening certain segments and the time-signature is modified by deleting certain segments.

7 Claims, 8 Drawing Sheets

METHOD AND APPARATUS FOR TEMPO AND DOWNBEAT DETECTION AND ALTERATION OF RHYTHM IN A MUSICAL SEGMENT

CROSS-REFERENCES TO RELATED APPLICATIONS

This application claims priority from provisional application Ser. No. 60/117,154, filed Jan. 25, 1999, entitled "Beat Synchronous Audio Processing", the disclosure of which is incorporated herein by reference.

BACKGROUND OF THE INVENTION

This invention relates to the fields of tempo and beat detection where the tempo and the beat of an input audio signal is automatically detected. Given an audio signal, e.g. a .wave or .aiff file on a computer, or a MIDI files (e.g., as recorded on computer from a keyboard), the task is to determine the tempo of the music (the average time in seconds between two consecutive beats) and the location of the downbeat (the starting beat).

Various techniques have been described for detecting tempo. In particular, in a paper by E. D. Scheirer, entitled "Tempo and Bean analysis of acoustic musical signals", J. Acoust. Soc. Am. 103 (1), January 1988, pages 588–601, a technique utilizing a bank or resonators to phase-lock with the beat and determine the tempo of the music is described. A paper by J. Brown entitled "Determination of the meter of musical scores by autocorrelation", J. Acoust. Soc. Am. 94(4), October 1993, pages 1953–1957, describes a technique where the autocorrellation of the energy curve of a musical signal is calculated to determine tempo.

Research continues to develop effective, computationally efficient methods of determining tempo and locating beats.

SUMMARY OF THE INVENTION

According to one aspect of the present invention, an cross-correlation technique that is computationally efficient is utilized to determine tempo. A click track having windows located at transient times of an audio signal is cross-correlated with a series of pulses located at the transient times. A peak detection algorithm is then performed on the output of the cross-correlation to determine tempo.

According to another aspect of the invention, beat locations candidates are determined by evaluating the fit a series of pulses, starting at $t_0$, with the click track. The fit is evaluated by perfoming a bi-directional search over inter-pulse spacing and the onset, $t_0$, of the pulses.

According to another aspect of the invention, the downbeats are located in a musical interval having a variable tempo by dividing the musical segments and determining local tempos for each segment and downbeat candidates for each segment. The downbeat candidate in a following segment is selected which varies by the second tempo period from the last beat of a preceding segment.

According to another aspect of the invention, for musical intervals with sudden tempo changes, it is determined whether a tempo candidate is accurate.

According to a further aspect of the invention, the rhythm of an audio track is modified by rearranging or modifying segments of the track located between beats.

According to a further aspect of the invention, swing is added to an audio track by lengthening the intervals between some beats and shortening the intervals between other beats.

According to another aspect of the invention, the time-signature of the musical interval is changed by deleting the segments between some beats.

Additional features and advantages of the invention will be apparent in view of the following detailed description and appended drawing.

DESCRIPTION OF THE SPECIFIC EMBODIMENTS

In all the following, input signal will mean, indifferently, the recorded audio signal or the contents of the MIDI file.

When it is possible to assume that the tempo of the input signal is constant over its whole duration, a fairly simple algorithm can be used, which is described with reference to FIGS. 1–5. This is the case for a wide variety of musical genres, in particular for music that was composed on an electronic sequencer. It is also true when the audio signal is of short duration (e.g. less than 10s), in which case it is often acceptable to assume that the tempo has not changed significantly over this short duration. In some cases however, the assumption of constant tempo cannot be made: one example is the recording of an instrumentalist who is not playing to an accurate and regular metronome. In such cases, the constant-tempo algorithm can be used on small portions of the audio file, to detect local values for the tempo and the downbeat. A constant-tempo algorithm is described and show this algorithm can be used to estimate a time-varying tempo is described with reference to FIGS. 6 and 7.

Figure 1:
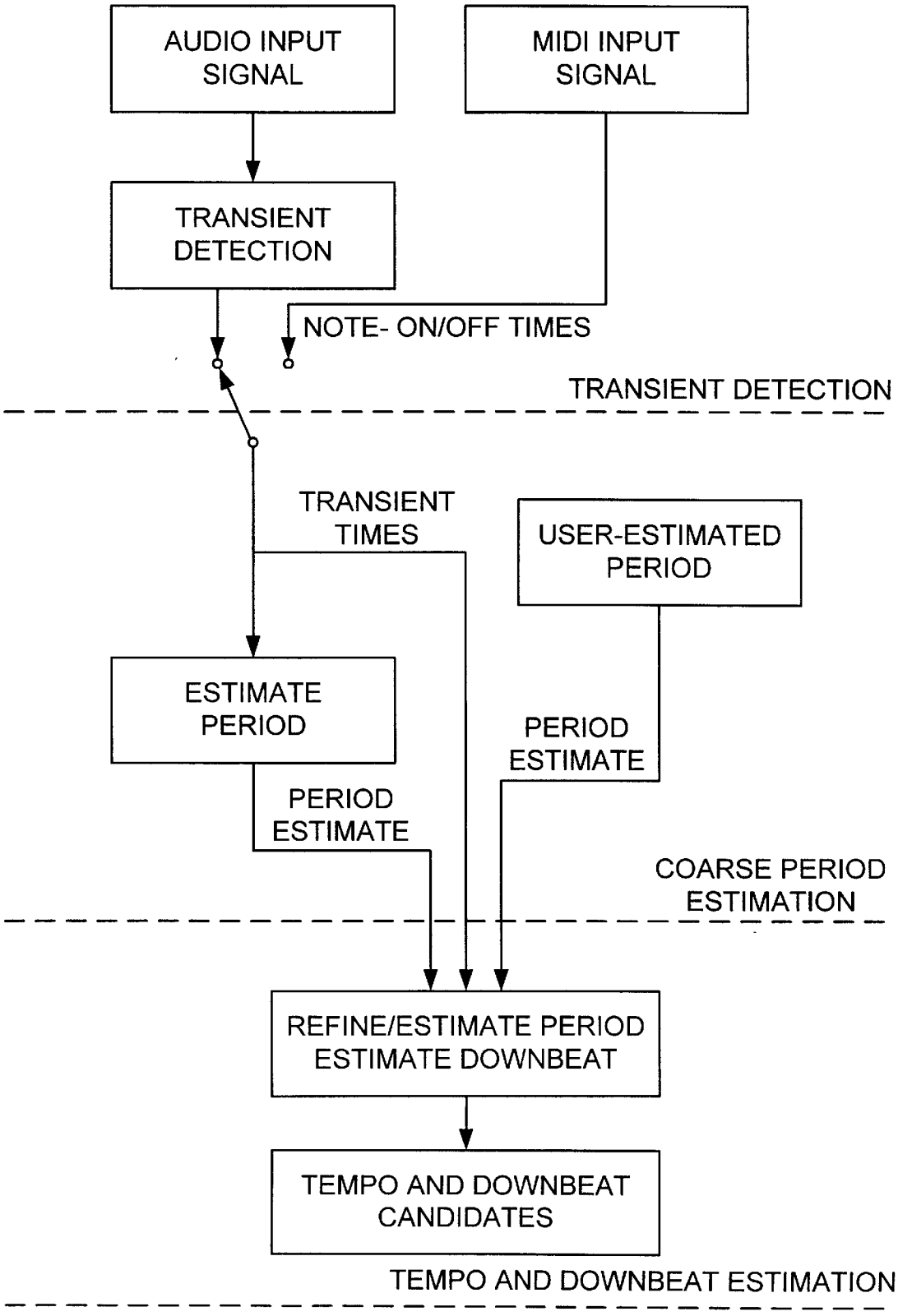
FIG. 1 is a block diagram depicting the tempo and downbeat detection procedure.

For audio input signals as shown in FIG. 1, the technique works in two successive stages: a transient-detection stage followed by the actual tempo and beat detection. For MIDI signals, the transient-detection stage can be skipped since the onset times can be directly extracted from the MIDI stream.

Transient Detection

This stage aims at detecting transients in an audio signal 101. On suitable technique for transient detection, (Step 103) is described in a commonly assigned patent application entitled "Method and Apparatus for Transient Detection and Non-Distortion Time Scaling" Ser. No. 09/378,377 filed on the same day as the present application which is hereby incorporated by reference for all purposes. At the end of the stage, a list of times ti at which transients occur is obtained, which can now be used as the input of our tempo-detection algorithm. For MIDI input 102, these transient times simply correspond to the times of note-on (and possibly note-off) events.

Tempo and Beat Detection

The tempo and beat detection algorithm uses a list of times $t_i$ (measured in seconds from the beginning of the signal) at which transients (such as percussion hits or note-onsets) occurred in the signal. The idea behind the algorithm is to best fit a series of evenly spaced impulses to the series of transient times, and the problem consists of finding the interval in samples (or period P) between each impulse in the series as well as the location of the first such impulse $\hat{t}_0$, or downbeat. There are at least three ways in which this can be accomplished:

One can first determine an approximated period $\hat{P}$ without estimating the location of the first beat (i.e., first estimate the tempo), then use this estimate $\hat{P}$ to obtain a refined tempo estimate and a downbeat estimate in a second stage Step 104 indicates this option.

One can ask the user to indicate an approximate tempo (e.g., by clicking on a button/mouse with the music) and then use this estimate $\hat{P}$ to obtain a refined tempo estimate and a plurality of downbeat candidates in a second stage Step 105 indicates this option.

One can estimate the period P and the candidate locations of the first impulse $\hat{t}$ in a single, more computation-costly step. Branch 106 indicates this option.

An estimate of the tempo (step 104) can be obtained by forming a click track (a signal at a lower sampling rate which exhibits narrow pulses at each transient time) and calculating its autocorrelation. To save computations, the autocorrelation can be implemented as a cross-correlation between the click track and a series of impulses at transient times. The procedure involves the following steps:

1. From the series of $N_{trans}$ transient times $t_i$, form a downsampled click track ct(n) by placing a click template h(n) (usually a symmetric window, e.g., a Hanning window) centered at each time $t_i$. Since this click track will be used to estimate the tempo and the downbeat, its sampling rate Sr can be as low as a few hundred Hz, with a standard value being around 1 kHz. The length of the click template can vary from 1 ms to 10 ms, with a typical value of 5 ms. The mathematical definition of the click track is:

$$ct(n) = \sum_{i=0}^{N_{trans}} h(n - t_i Sr) \tag{1}$$

2. Choose a minimum and a maximum tempo in BPM (Beats per minute) between which the BPM is likely to fall. Typical values are 60 BPM for the minimum and 180 for the maximum. To the minimum tempo corresponds a maximum period Pmax and to the maximum tempo corresponds a minimum period Pmin expressed in samples at the click track sampling rate Sr. Mathematically $$P_{\max} = \frac{60Sr}{Tempo_{\min}} \quad \text{and} \quad P_{\min} = \frac{60Sr}{Tempo_{\max}}$$

3. Rather than calculating the autocorrelation of the click track ct(n), which would require a large number of calculations, in the order of $(P_{max}-P_{min})\times L_{ct}$ multiplications and additions, where $L_{ct}$ is the length of the click track in samples, one can calculate the cross-correlation $R_{ct}(\tau)$ between the click track ct(n) and a series of pulses placed at the click times expressed in the click track sampling rate Sr. Mathematically the cross-correlation can be expressed as:

$$R_{ct}(\tau) = \sum_{i=0}^{N_{trans}} ct(t_i Sr + \tau) \text{ for } P_{\min} \le \tau \le P_{\max}$$

which requires only in the order of $N_{trans}\times(P_{max}-P_{min})$ multiplications and additions.

Figure 2:
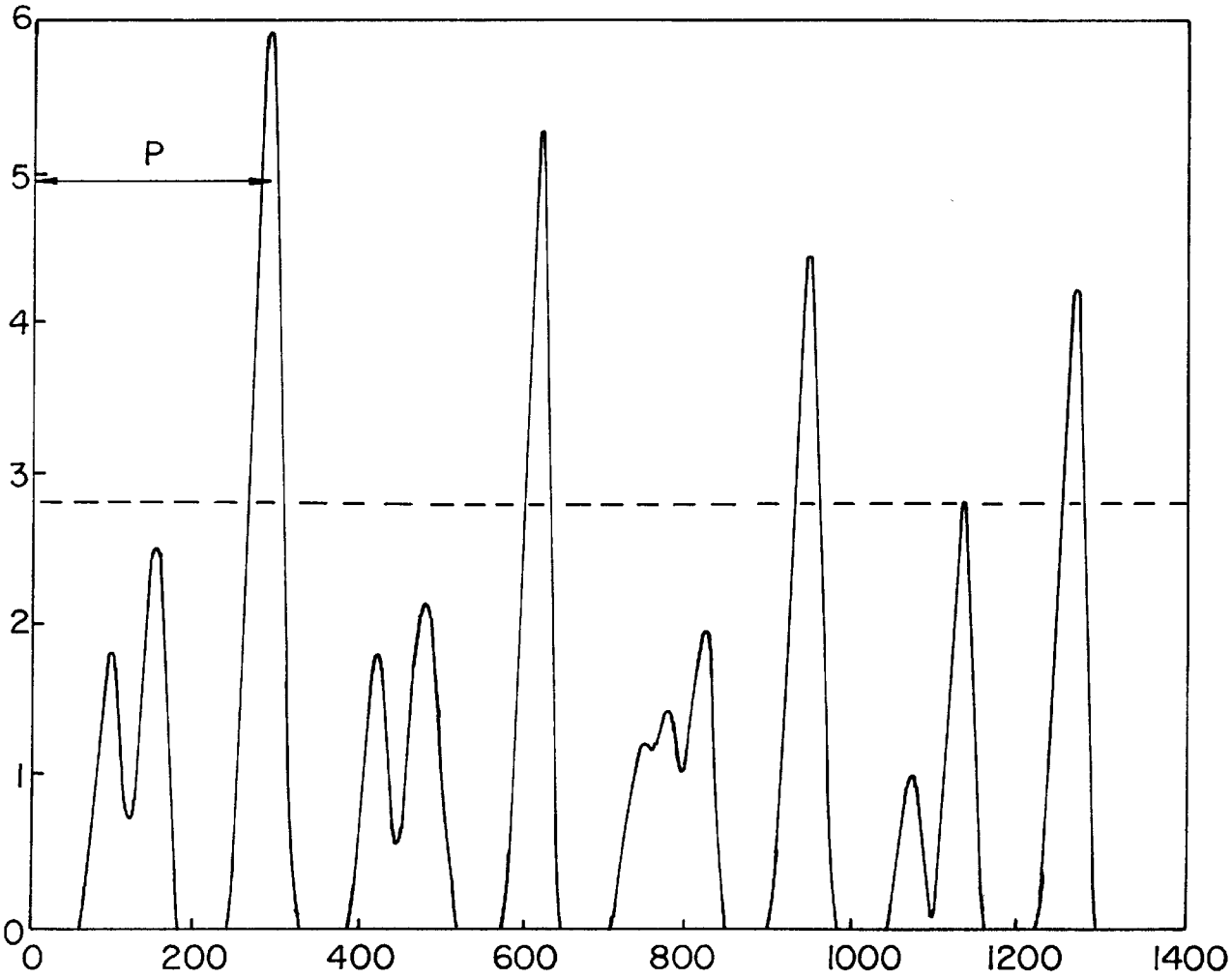
FIG. 2 is a graph of the cross-correlation of the click track and impulse track.

4. The cross-correlation $R_{ct}(\tau)$, an example of which is shown in FIG. 2, typically exhibits peaks that indicate self-similarity in the click-track, which can be used to get an estimate of the tempo. If there is a peak in the cross-correlation at $\tau$=P, then it is likely that there will be one at $\tau\approx$2P; 3P; . . . because a signal that has a period $P_0$ is also periodic with period $2P_0 3P_0$ and so on. However, the smallest period $P_0$ is of interest so the peak corresponding to the smallest r (i.e., the smallest period) must be found. One way to do this is to detect all the peaks in the cross-correlation (retaining only those flanked by low enough valleys) and only retain those whose heights are larger than $\alpha$ times the average of all peak heights. Typical values for $\alpha$ range from 0.5 to 0.75. Among the remaining peaks, the one corresponding the smallest $\tau$ is selected as the "period peak" and the estimated period $\hat{P}$ is set to the peak's $\tau$. This is described in FIG. 2 where circles indicate peaks flanked by deep enough valleys and the dotted line indicates the average height of such peaks. Arrows indicate peaks lying above this average and the square indicates the peak retained as indicating the period P.

At the end of this stage, an estimate value of the period $\hat{P}$ is obtained. As mentioned above, an alternate way of obtaining this estimate is to let the user tap to the music (for example by clicking on a button), and calculating the average of the time interval between two successive taps. In both cases, the next task is refining the tempo estimate (step 107) and obtaining candidates for the location of the first beat (step 108).

Refining the Tempo/Obtaining Beat Location Estimates

Figure 5:
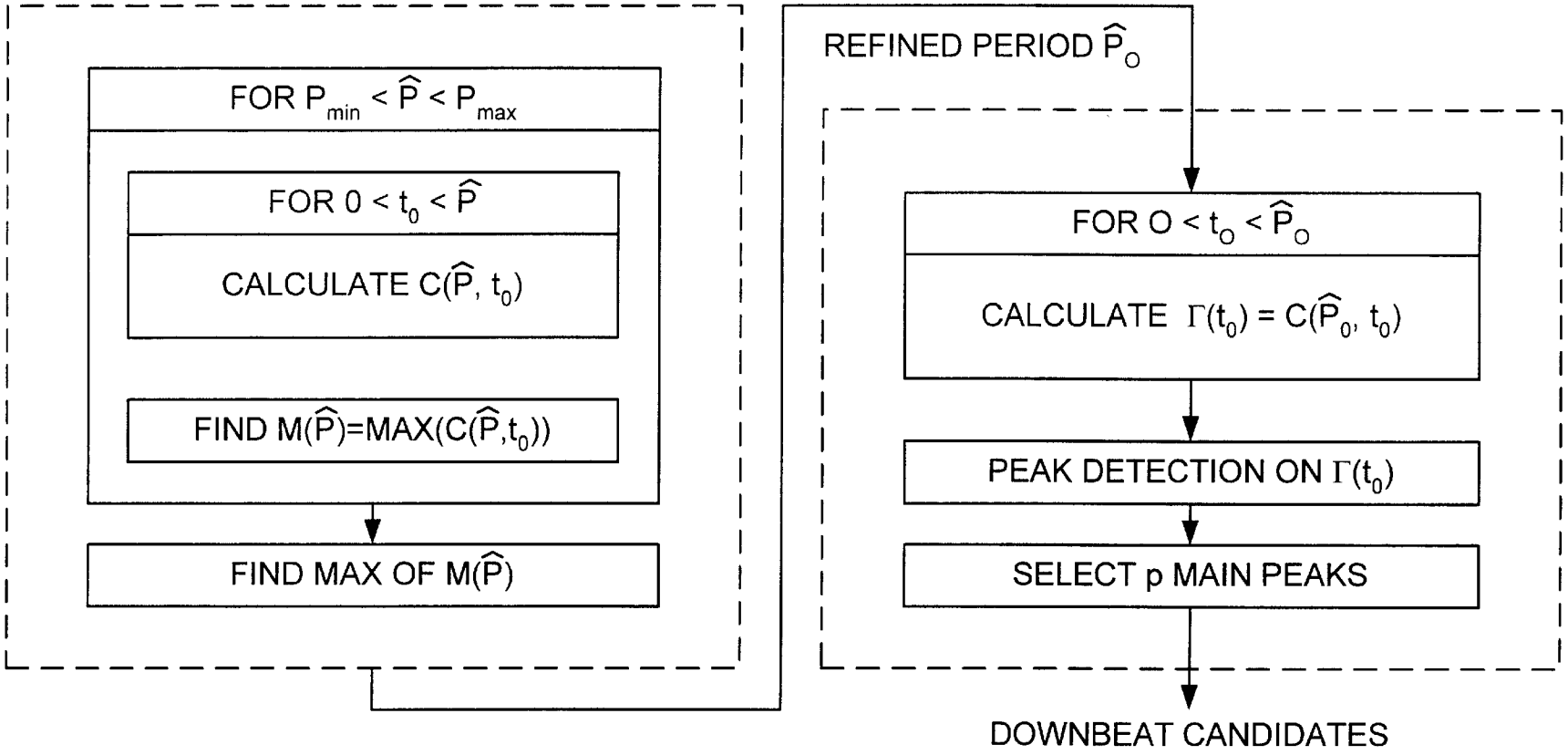
FIG. 5 is block diagram of a procedure for refining the period estimate and determining downbeat candidates.

The task of determining where the downbeat of a musical track should fall is not an easy one, even for human listeners. Rather than trying to obtain a definite answer to that question, this approach aims at obtaining various downbeat candidates, sorted in order of likelihood. If the algorithm does not come up with what the user think the downbeat should be, the user can always go to the next most likely downbeat candidate until a satisfactory answer is obtained FIG. 5 shows an example of the steps at this stage.

Figure 3:
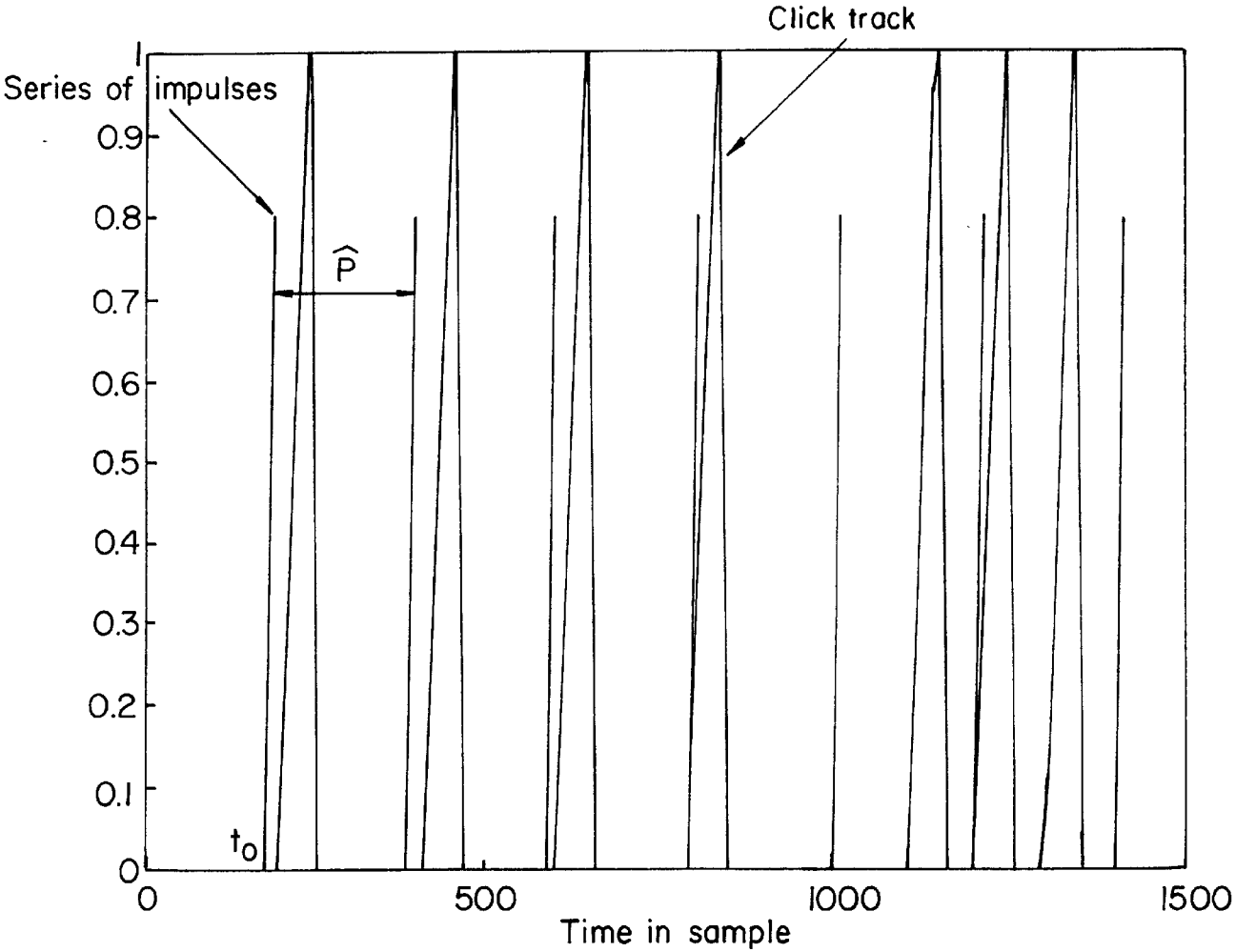
FIG. 3 is graph depicting a fitting a series of impulses to the click track.
Figure 4:
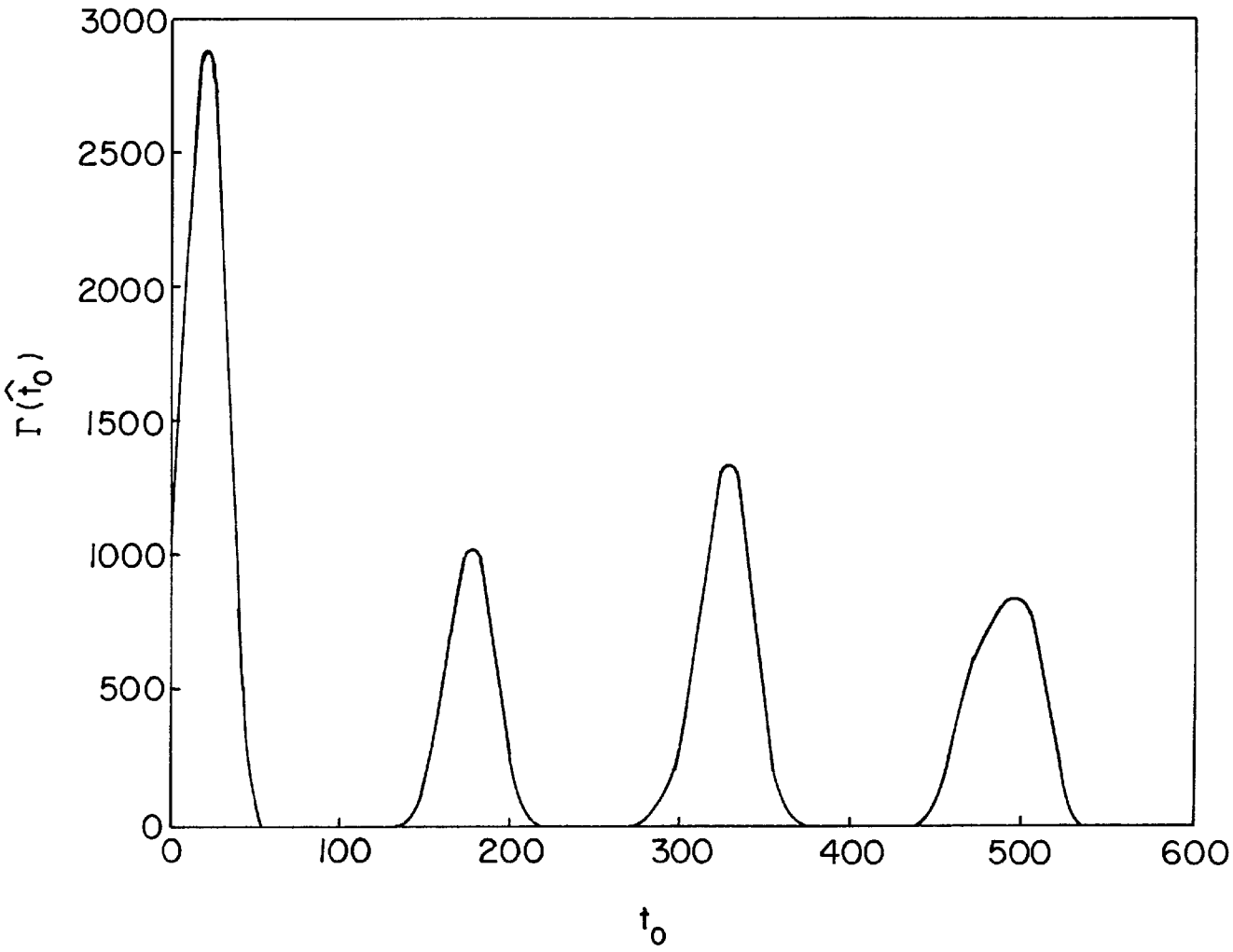
FIG. 4 is a graph of the cross-correlation of the impulses and the click track showing beat candidates.

The idea behind this stage is to best fit a series of evenly spaced impulses to the series of transient times, which requires adjusting the time-interval between impulses $\hat{P}$ and the location of the first impulse (first beat) $\hat{t}_0$. FIG. 3 illustrates this idea. In FIG. 3 the fit between the series of impulses and the series of transient times is evaluated by calculating the cross-correlation between the series of impulses and the click track. Two steps are involved in this procedure:

1. In step 151, the fit between the series of impulses and the series of transient times can be evaluated by calculating the cross-correlation between the series of impulses and the click track defined above.

This cross-correlation is a function of both the period $\hat{P}$ and the location of the first impulse $\hat{t}_0$, and can be calculated using the following equation:

$$C(\hat{P}, \hat{t}_0) = \sum_{i=0}^{N_{trans}} ct(\hat{t}_0 + i\hat{P}) \quad (3)$$

As in the previous stage, a minimum period $P_{min}$ must be selected and a maximum period $P_{max}$ between which the actual tempo period $\hat{P}_0$ is likely to fall. If there is already an estimate $\hat{P}$ of the period, for example as described with reference to FIG. 2, then $P_{min}$ and $P_{max}$ can be fairly close to $\hat{P}$ (for example about 2 to 3 ms apart), which will reduce the number of calculations required by the maximization. If there is not an initial estimate of $\hat{P}$, then $P_{min}$ and $P_{max}$ can be chosen as described above with reference to step 104 of FIG. 1. In order to determine the best fit, Eq. (3) must be maximized over all acceptable values of $\hat{P}$ and $\hat{t}_0$, in a bi-dimensional search. One way to conduct this bi-dimensional search is to maximize over $\hat{t}_0$ for each $\hat{P}$, then to maximize over $\hat{P}$ as shown in loop 153 of FIG. 5.

For each value of $\hat{P}$ between $P_{min}$ and $P_{max}$, Eq. (3) is evaluated for $\hat{t}_0$ between 0 and $\hat{P}$. As a result, for each value of $\hat{P}$, the maximum of $C(\hat{P}; \hat{t}_0)$ over $\hat{t}_0$ can be determined:

$$M(\hat{P})=\max C(\hat{P}; \hat{t}_0) \text{ for } \hat{t}_0=0, 1, \ldots \hat{P}$$

Then the maximum of $M(\hat{P})$ over all $\hat{P}$ can now be found (step 154). This maximum yields $\hat{P}_0$ (the value of $\hat{P}$ that generated this maximum). This is taken to be the tempo period of the signal in samples at the sampling rate Sr.

2. In step 152, several candidates for the location of the first beat can then be found. Estimating $C(\hat{P}; \hat{t}_0)$ (now a function of $\hat{t}_0$ only, since $\hat{P}_0$ is fixed) for all values of $\hat{t}_0$ between 0 and $\hat{P}_0$ yields function $\Gamma(\hat{t}_0)$, in step 155

$$\Gamma(\hat{t}_0)=C(\hat{P}_0; \hat{t}_0) \text{ for } 0 \leqq \hat{t}_0 \leqq \hat{P}_0;$$

By performing a basic peak detection on $\Gamma(\hat{t}_0)$ (step 156) the p most prominent maxima in $\Gamma(\hat{t}_0)$ can be found which are taken to correspond to the p most likely first beat locations (step 157), expressed in samples at the sampling rate Sr. An example $\Gamma(\hat{t}_0)$ function is given in FIG. 4 which shows four main peaks which indicate the four most likely locations for the first beat.

The bi-dimensional search in step 151 can be sped up by evaluating the maximum in $M(\hat{P})$ over a subset of $\hat{t}_0=0; 1 \ldots \hat{P}$. For example, one can evaluate the maximum over to $\hat{t}_0=0$, k, 2k, . . . $\hat{P}$ where k is an integer equal to 2 or more. However, step 152 (obtaining candidates for the location of the first beat) requires evaluating $\Gamma(\hat{t}_0)$ over the whole range $0 \leqq \hat{t}_0 \leqq \hat{P}_0$; and not over a subset of it.

Figure 6:
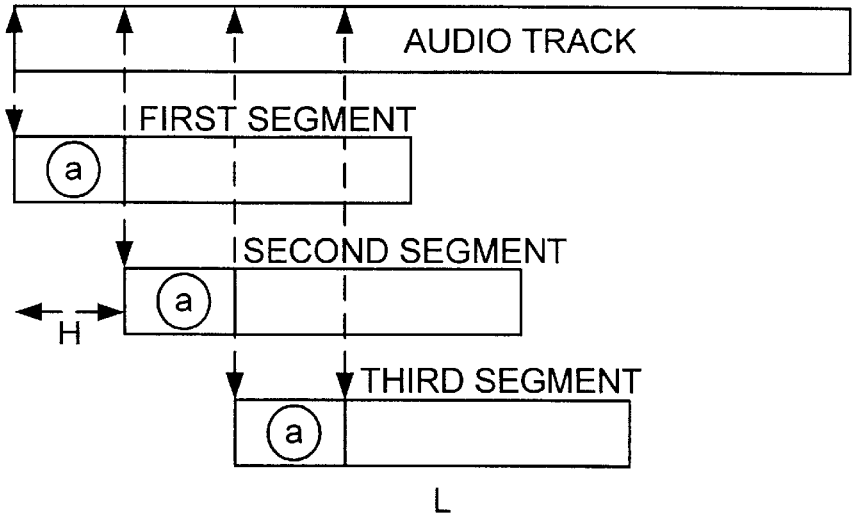
FIG. 6 is a block diagram showing overlapping segments of an audio track.

The basic algorithm will now be described. When the signal has a time-varying tempo, the approach described above cannot be used directly, because it relies of the assumption of a constant tempo. However, if the signal is cut into small overlapping segments, and if the tempo can be considered constant over the duration of these segments, it is possible to apply the above algorithm locally on each segment, taking care to insure proper continuity of the tempo and of the downbeat. The algorithm works as follows:

1. As illustrated in FIG. 6, the input signal is decomposed into successive, overlapping small segments 601–603 which are then analyzed by use of the constant-tempo algorithm described with reference to FIGS. 1–5. The length L of each segment can range from 1 second to a few seconds, typically 3 or 4. Long segment lengths help obtain reliable tempo estimates and downbeat estimates. However, short lengths are needed to accurately track a rapidly changing tempo. Each segment is offset from the preceding one by H seconds, typically a few tenths of a second. Small offset values yield more accurate tracking but also increase the computation cost.
2. On the first segment 601, a constant-tempo estimation is carried-out, according to the algorithm described with reference to FIGS. 1–5 which yields a tempo estimate $\hat{P}_0$ (0) and a downbeat estimate $\hat{t}_0$ (0).
3. On the next segment 602, and on all successive ones (segment i in general), a constant-tempo estimation is carried-out with $P_{min}<\hat{P}_0$ (i−1)$<P_{max}$ and $P_{max}-P_{min}=\delta$ set to a small value. This way, the algorithm is forced to pick a local estimate of the tempo $\hat{P}_{local}$ that is close to the one obtained in the preceding frames $\hat{P}_0$ (i−1). The exact value of δ should depend on the amount of overlap, as controlled by H, since the more overlap, the less likely the tempo is to have changed from one segment to the next. δ is typically a few hundreds of milliseconds.
4. The estimate of the tempo in the current segment $\hat{P}_0$ (i) is then calculated based on the local estimate of the tempo $\hat{P}_{local}$ and the tempo in the preceding frames $\hat{P}_0$ (i−k), k>1 by use of a smoothing mechanism.

One example is a first order recursive filtering: $\hat{P}_0$ (i)=α$\hat{P}$ local+(1−α) $\hat{P}_0$(i−1) where α is a positive constant smaller than 1. α close to 0 causes a lot of smoothing, while α close to 1 does not.

Figure 7:
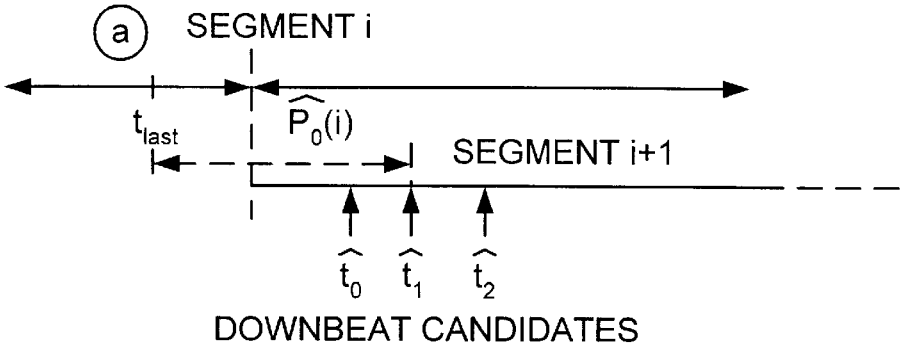
FIG. 7 is a diagram depicting downbeat candidates for a track with variable tempo.

5. The algorithm produces a series of downbeat candidates, among which the current downbeat will be selected, such that the time elapsed between the last beat in part "a" of the preceding segment (see FIG. 7) and the first beat of the current segment is as close to a multiple of the current estimate of the tempo $\hat{P}_0$ (i) as possible. Specifically, if the last beat in part "a" of the preceding segment occurred at time $t_{last}$ (as measured from the beginning of the audio track, and if $\hat{t}_k$k=0, 1, . . . p are the p downbeat candidates, one calculates $$\Delta_{k_0=} = \frac{\hat{t}_{k_0} - t_{last}}{\hat{P}_0(i)}$$

and calculates the integer closest to it, denoted by $|\Delta_{k_0}|$. For example, if $\Delta_{k_0}$ 1.1 or 0:9, then $|\Delta_{k_0}$=1. The candidate $k_0$ that minimizes the absolute value of $(\Delta_{k_0}-|\Delta_{k_0}|)$ is then selected. This is illustrated in FIG. 7. In FIG. 7, $\hat{t}_l-t_{last}$ is close to $\hat{P}_0$ (i).

6. The downbeat in the current segment $\hat{t}_i(0)$ is then obtained from $\hat{t}_{k_0}$ as an average between $\hat{t}_{k_0}$ and $t_{last}\pm|\Delta_{k_0}|\hat{P}_0(i)$, for example $\hat{t}_i(0)=\beta\hat{t}_{k_0}+(1-\beta)(t_{last}\pm|\Delta_{k_0}|\hat{P}_0(i))$ where β is a positive constant smaller than 1.
7. The algorithm proceeds in this way until the last segment has been analyzed.

In some audio tracks, the tempo varies abruptly at some point, for example suddenly going from 120 BPM to 160 BPM. The above algorithm would not be able to track this abrupt change because of the underlying assumption that the tempo in any given segment is close that that in the preceding segment. To detect sudden tempo changes, one can monitor the accuracy of the tempo estimate $\hat{P}_{local}$ in each segment by comparing the value of $C(\hat{P}_{local}; \hat{t}_0)$ to the overall maximum of the function C. Recall that in order to obtain $\hat{P}_{local}$, $C(\hat{P}; \hat{t}_0)$ is maximized for $P_{min} < \hat{P} < P_{max}$ where $P_{min}$ and $P_{max}$ are close to the estimate of the tempo in the preceding frame $\hat{P}_0$ (i−1). If $C(\hat{P}; \hat{t}_0)$ is evaluated over a larger range $P'_{min} < \hat{P} < P'_{max}$, a value of $\hat{P}$ might be found that corresponds to a larger $C(\hat{P}, \hat{t}_0)$ than $C(\hat{P}_{local}, \hat{t}_0)$. The ratio $$\pi = \frac{C(\hat{P}_{local} - \hat{t}_0)}{\max_{[P'_{min} \le P \le P'_{max}, t_0]} C(\hat{P}, t_0)}$$

which is necessarily smaller than or equal to 1, indicates whether the tempo picked under the constraint that it should be close to the preceding one is as likely as the tempo that would have picked without this constraint. A ratio close to 1 indicates the local tempo is actually a good candidate. A small ratio indicates that our local tempo is not a good candidate, and a sudden tempo change might have occurred. By monitoring $\pi$ at each segment, sudden tempo changes can be detected as sudden drops in the value of $\pi$. For example, one can maintain a "badness" counter u(i) updated at each segment in the following way:

if $\pi$ in the current segment is smaller than a threshold $\pi_{min}$, say 0.4, the counter u(i) is incremented by $u_{bad}$, e.g., $u(i)=u(i-1)+u_{bad}$.

if $\pi$ in the current segment is larger than a threshold $\pi_{max}$, say 0.6, the counter u(i) is decremented by $u_{good}$, e.g., $u(i)=u(i-1)-u_{good}$ if $u(u-1)>u_{good}$ and u(i)=0 otherwise if at frame i the counter u(i) is larger than a threshold $u_{max}$, it is decided that there has been a sudden tempo change and the tempo is re-estimated as in the first segment (i.e., without constraining $\hat{P}$ to be close to the estimate in the preceding segments).

Sudden Downbeat Changes

In some rare cases, the downbeat of the track might also change abruptly (for example, because there is a short pause in the performance). The same algorithm described for sudden tempo changes can be used for sudden downbeat changes, except that one monitors the ratio of the value of $\Gamma(\hat{t}_{k_0})$ for the downbeat selected in the current frame, $\hat{t}_{k_0}$, with the overall maximum of function $\Gamma$. The same scheme as above can be used to decide when a sudden downbeat change occurred.

Beat Machine

The following describes a series of techniques that can be used to modify the rhythm of an audio track, and a specific embodiment referred to herein as the Beat Machine. The audio track can be a .wav or .aiff as in a computer-based system, or any other type of wavefile stored in a recording device. The techniques described here all rely on the assumption that the tempo and downbeat of the audio track have been determined, either manually or by use of appropriate techniques such as described above. The tools also make extensive use of transient-synchronous time-scaling techniques.

In the rest of this specification, the following assumptions and naming conventions are used:

The Beats in the original Audio file have been located in the form of an array of times $t_i^b$ in samples measured from the beginning of the audio track, at which each beat occurs. These beats do not have to be uniformly distributed, which means that the tempo does not have to be constant (i.e., the difference $t_{i\pm1}^b - t_i^b$ can vary in time). For constant-tempo files, however, this difference will be a constant (independent of i) equal to the tempo period.

Further, an event-based time-scaling algorithm that can be used to time-scale any given segment of audio by an arbitrary factor. The time-scaling factor must be able to vary from one segment to the next. Such a time-scaling technique is described in the above-referenced patent application.

Adding or Removing Swing to the Audio Track

The swing is a rhythm attribute that describes the unevenness of the division of the beat. For example, assuming that each beat is divided into two half-beats, a square rhythm (without swing) would be one where the duration of the two half-beats are equal. A swing rhythm would be one where the first half-beat is typically longer than the second half-beat, the amount of swing being usually measured by the ratio in percent of the difference in duration to the duration of the whole beat.

Assuming that each beat is evenly divided into N sub-beats (2 half-beats or 4 quarter-beats), swing can be added to the track by time-expanding the first sub-beat, then time-compressing the second sub-beat, and repeating this operation of all the sub-beats in every beat, in such a way that the total duration of the time-scaled sub-beats is equal to the original duration of the beat. For example, assuming that the beat is divided into two half-beats, the first half-beat can be time-expanded by a factor $0 \leqq \alpha < 1$ (its duration being multiplied by $1+\alpha$) and the second half-beat time-compressed by a factor $1-\alpha$ (its duration multiplied by $1-\alpha \leqq 1$), so that the total duration is $(1+\alpha)L/2+(1-\alpha)L/2=L$ where L is the duration of the original beat. Swing can be removed by using a negative factor a so that the first sub-beat is time-compressed (becomes shorter) and the next one is time-expanded (becomes longer).

A technique for adding swing will be described with reference to FIG. 8. The locations of beat times are stored as beat pointers in a beat pointer table 800. These times are addresses into a digitized musical file 802 and address a segment beginning at a specified beat. A play list 804 is used to play the musical interval with swing added. Each entry in the play list includes a beat pointer and a time scaling factor. When the musical interval is played, the play list is utilized to access a beat segment of the musical file located between successive beats indicated by the beat pointers. A musical time-scaling algorithm utilizes the stored time scaling factor to scale the musical segment according to the factor and passes a scaled beat segment to be played back as audio.

In addition, swing can be added at multiple levels: Dividing each beat in four quarter beats, one can add swing at the quarter-beat level as described above, then add swing at the half-beat level, by time-scaling the two first quarter-beats by a factor of $\beta$ then time-scaling the two last ones by a factor $1-\beta$. Any such combination is possible.

Altering the Time-Signature

The time-signature of a musical piece describes how many beats are in a bar, and are usually written as a ratio P/Q, where $\hat{P}$indicates how many beats are in a bar, and Q indicates the length of each beat.

Typical time-signatures are 4/4, (a bar containing four beats each equal to on quarter-note), 3/4 (three beats per bar, each beat is a quarter-note long), 6/8 (six eighth-notes in a bar) and so on.

Because it is known where the beats are located in the audio track, it is very easy to alter the time-signature by discarding or repeating beats or subdivisions of beats. For example, to turn a 4/4 signature into a 3/4 signature, one can discard one beat per bar and only play the three others. Care must be taken to cross-fade the signals left and right of the discarded beat to avoid audible discontinuities.

Figure 9:
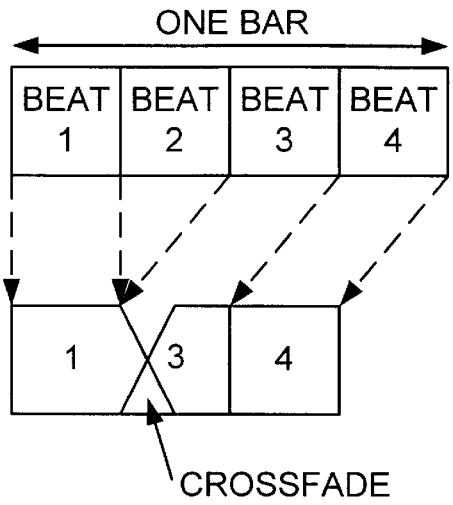
FIG. 9 is a schematic diagram illustrating cross-fading.

See FIG. 9 for such an example: The signal at the end of beat 1 is given a decreasing amplitude, while the signal at the beginning of beat 3 is given an increasing amplitude, and the two are added together in the cross-fade area. To turn a 4/4 time-signature into a 5/4 signature, one can repeat a beat per bar, thus making the bar 5 beats long instead of 4. Again, care must be taken to cross-fade the signals left and right of the repeated beat to avoid discontinuities. Referring to FIG. 1, the play list would include a modified list of beat pointers organized as described above.

As in the preceding section, the beat can also be evenly divided into N sub-beats (2 half-beats or 4 quarter-beats), which can be skipped or repeated to achieve a wider range of time-signatures. For example, a 4/4 time-signature can be turned into a 7/8 time-signature by splitting each beat into two half-beats, and skipping one half-beat per bar, thus making the bar 7 half-beat long instead of 8.

Changing the Order of the Beats/Sub-Beats

Another type of modification that can be applied to the signal consists of modifying the order in which beats or sub-beats are played. For example, assuming a bar contains 4 beats numbered 1 through 4 in the order they are normally played, one can choose to play the beats in a different order such as 2-1-4-3 or 1-3-2-4. Here too, care must be taken to cross-fade signals at beat boundaries, to avoid audible discontinuities. Obviously, the same can be done at the half-beat or quarter-beat level.

Performing Beat-Synchronous Effects

Another type of modification consists of applying different audio effects to different beats in a bar: For example in a four-beat bar, beat 1 and 3 could be pitch-shifted by a certain amount, while beat 2 and 4 could be ring-modulated.

Figure 8:
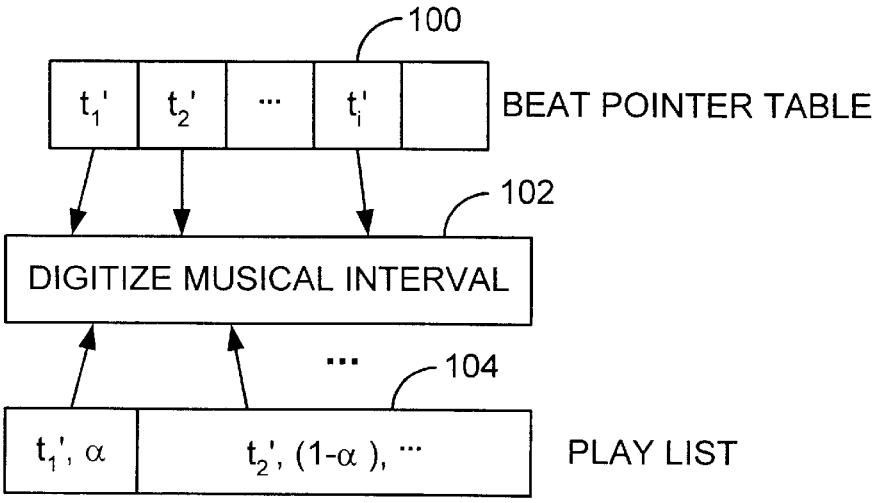
FIG. 8 is a block diagram of a beat pointer table and play list.

Referring to FIG. 8, pitch shifting and ring-modulating factors are included in the play list 804.

Mixing Beats from Different Sources

Assuming two different audio tracks have been analyzed so their respective tempo and beat location are known, a composite signal can be generated by mixing beats extracted from the first signal with beats extracted from the second signal. For example, a 4/4 time-signature signal could be created in which every bar includes 2 beats from the first signal and two beats from the second, played in any given order. The same precaution as above applies, in that cross-fading should be used at beat boundaries to avoid audible discontinuities.

Figure 10:
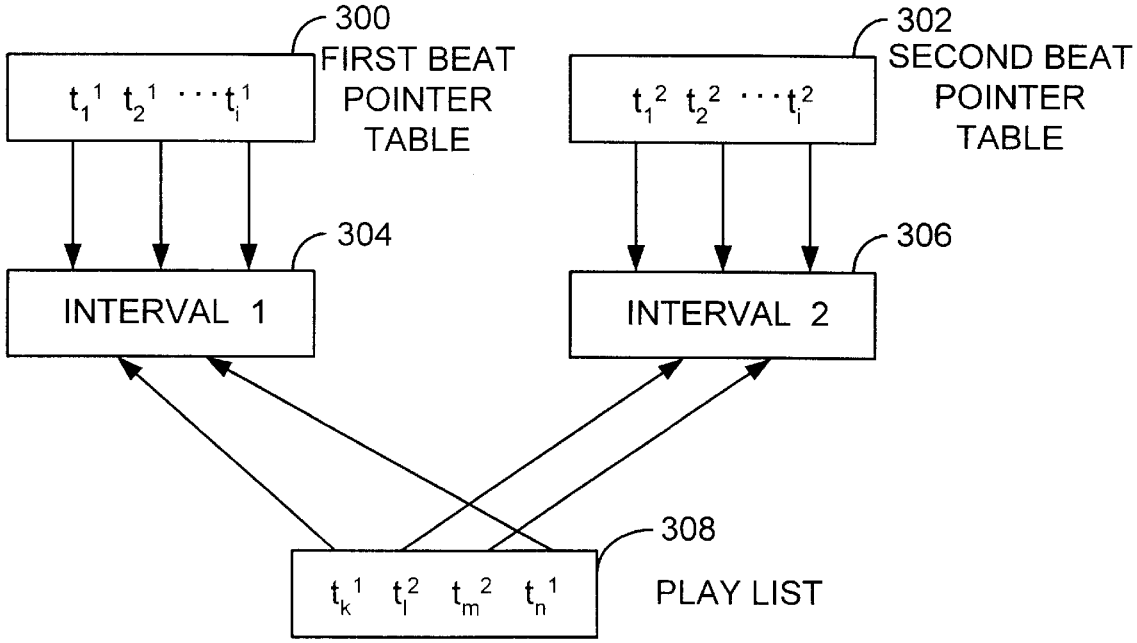
FIG. 10 is a block diagram of pointer tables and a play list for selecting segments from multiple tracks.

A technique for adding mixing beats will be described with reference to FIG. 10. The beat pointers for first and second musical intervals are stored in first and second beat pointer tables 300 and 302. These pointers are addresses into, respectively, first and second digitized musical files 304 and 306, and address a segment beginning at a specified beat. A play list 308 is used to play a musical interval with beats from the two digitized musical files. The play list includes beat pointers from both first and second tables 300 and 302.

Figure 11:
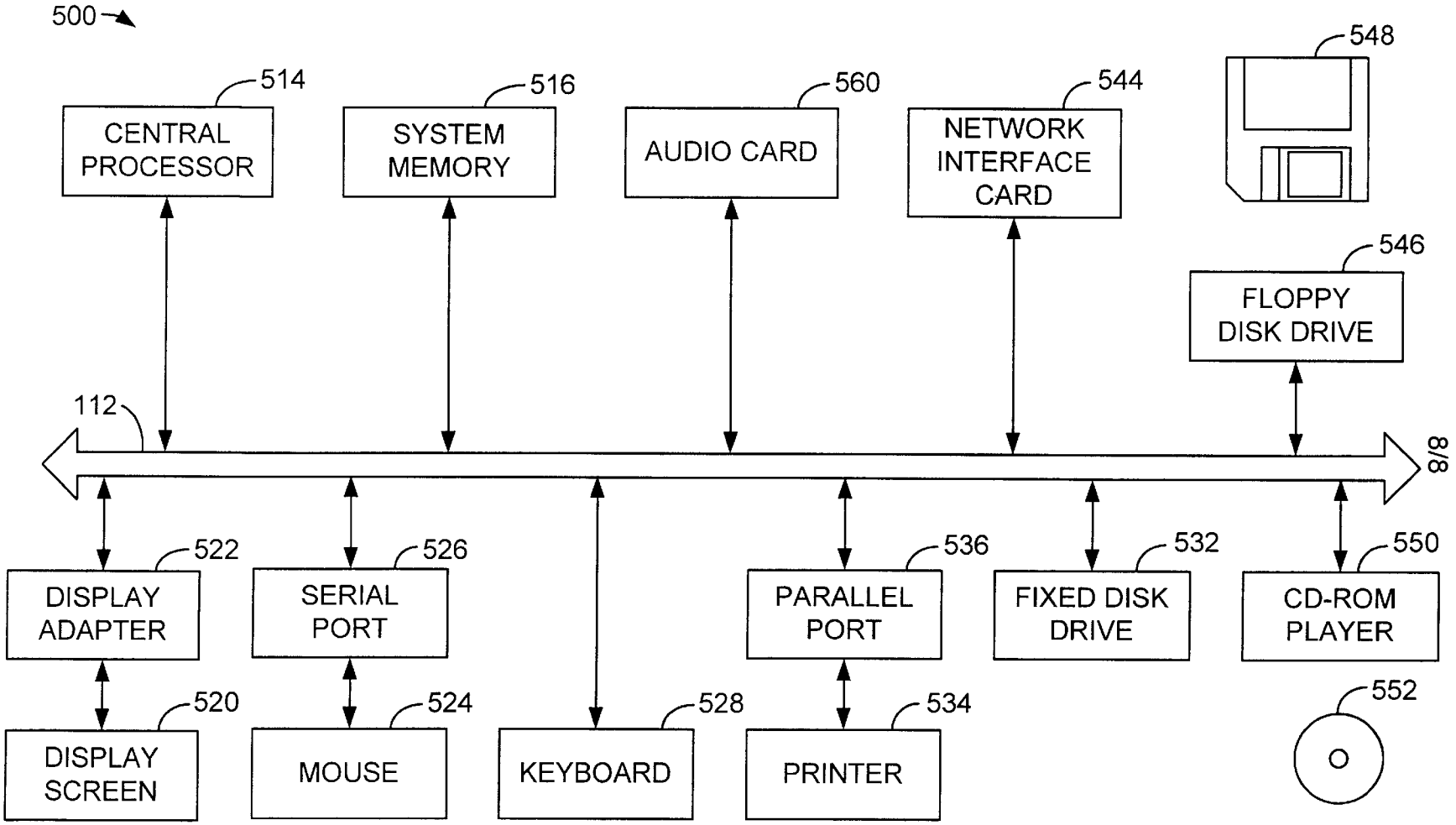
FIG. 11 is a block diagram of a system for performing the invention.

FIG. 11 shows the basic subsystems of a computer system 500 suitable for implementing some embodiments of the invention. In FIG. 11, computer system 500 includes a bus 512 that interconnects major subsystems such as a central processor 514 and a system memory 516. Bus 512 further interconnects other devices such as a display screen 520 via a display adapter 522, a mouse 524 via a serial port 526, a keyboard 528, a fixed disk drive 532, a printer 534 via a parallel port 536, a network interface card 544, a floppy disk drive 546 operative to receive a floppy disk 548, a CD-ROM drive 550 operative to receive a CD-ROM 552, and an audio card 560 which may be coupled to a speaker (not shown) to provide audio output. Source code to implement some embodiments of the invention may be operatively disposed in system memory 516, located in a subsystem that couples to bus 512 (e.g., audio card 560), or stored on storage media such as fixed disk drive 532, floppy disk 548, or CD-ROM 552.

Many other devices or subsystems (not shown) can be also be coupled to bus 512, such as an audio decoder, a sound card, and others. Also, it is not necessary for all of the devices shown in FIG. 11 to be present to practice the present invention. Moreover, the devices and subsystems may be interconnected in different configurations than that shown in FIG. 11. The operation of a computer system such as that shown in FIG. is readily known in the art and is not discussed in detail herein.

Bus 512 can be implemented in various manners. For example, bus 512 can be implemented as a local bus, a serial bus, a parallel port, or an expansion bus (e.g., ADB, SCSI, ISA, EISA, MCA, NuBus, PCI, or other bus architectures). Bus 512 provides high data transfer capability (i.e., through multiple parallel data lines). System memory 516 can be a random-access memory (RAM), a dynamic RAM (DRAM), a read-only-memory (ROM), or other memory technologies.

In a preferred embodiment the audio file is stored in digital form and stored on the hard disk drive or a CD ROM and loaded into memory for processing. The CPU executes program code loaded into memory from, for example, the hard drive and processes the digital audio file to perform transient detection and time scaling as described above. When the transient detection process is performed the transient locations may be stored as a table of integers representing to transient times in units of sample times measured from a reference point, e.g., the beginning of a sound sample. The time scaling process utilizes the transient times as described above. The time scaled files may be stored as new files.

The invention has now been described with reference to the preferred embodiments. Alternatives and substitutions will now be apparent to persons of skill in the art in view of the above description. Accordingly, it is not intended to limit the invention except as provided by the appended claims.

What is claimed is:

1. A method for determining the tempo period, P, of a musical segment stored as a digital file, said method comprising the steps of:

determining a series of transient times, $t_i$, measured from the beginning of the digital file where transients occur in the musical segment;

generating a click track having a click template at each $t_i$;

cross-correlating the click track with a series of impulses located at the transient times to form a cross-correlation function as a function of a first time variable; and performing peak detection on said cross-correlation function to select a value of the first time variable at a first detected peak as a tempo period candidate for the musical segment.

2. A method of determining the location of downbeats in a musical segment stored as a digital file, said method comprising the steps of:

determining a series of transient times, $t_i$, at times measured from the beginning of the digital file where transients occur in the musical segment;

generating a click track having a click template at each $t_i$;

evaluating the fit between a series of beat candidate impulses starting at $t_0$, measured from the beginning of the digital file, with the click track, where the impulses are separated by P seconds, by performing the following steps:

selecting a range of values of P between $P_{min}$ and $P_{max}$;

for a given P between $P_{min}$ and $P_{max}$, determining the maximum, M(P), of the cross-correlation of the click track and the beat candidate impulses for values of $t_0$ between 0 and the given P;

determining the maximum of M(P) for all values of P between $P_{min}$ and $P_{max}$, with $P_0$ being the value of P at the maximum;

selecting $P_0$ as the value of the separation of the impulses; and determining peaks of the cross-correlation of the click track and the series of impulses with $P=P_0$ as a function of $t_0$ to determine downbeat candidates equal to the values of $t_0$ at the peaks.

3. A method of determining the location of downbeats in musical interval, having a variable tempo, with the musical interval stored as a digital file, said method comprising the steps of:

dividing the musical interval into a series of overlapping segments;

for the first segment:

determining a series of transient times, $t_i$, measured from the beginning of the digital file where transients occur in the musical segment;

generating a click track having a click template at each $t_i$;

cross-correlating the click track with a series of impulses located at the transient times to form a cross-correlation function as a function of a first time variable;

performing peak detection on said cross-correlation function to select a value of the first time variable at a first detected peak as the tempo period, $P_0(0)$, of the first musical segment; and determining downbeat candidates, with a last downbeat candidate occurring at $t_{last}$; and for the second segment:

estimating a local tempo, $P_{local}$, that is close to $P_0(0)$;

selecting a second tempo period for the second segment by averaging the tempo periods of the first segment, $P_0(0)$, and $P_{local}$;

determining a series of downbeat candidates; and selecting one of the series of downbeat candidates separated from $t_{last}$ by an integral multiple of the second tempo periods as the downbeat candidate $t_0(1)$ for the second segment.

4. The method of claim 3 further including an additional method for determining whether a sudden tempo change occurs in the musical interval, said additional method comprising the steps of:

determining the value of the cross-correlation function of $P_{local}$ and $t_0(1)$ with the click track;

determining the maximum value of the cross-correlation of P and $t_0(1)$ for P over a large range;

forming the ratio of the value to the maximum value; and if the ratio is much less than one, indicating that a sudden tempo change has occurred and that $P_{local}$ is not a good tempo period candidate.

5. A system for locating downbeats in a musical interval, said system comprising:

a central processing unit;

a memory, with the memory storing a digitized audio track encoding the musical interval, and program code;

a bus coupling the central processing unit;

with the central processing unit for executing:

program code for determining a series of transient times, $t_i$, at times measured from the beginning of the digital file where transients occur in the musical segment;

program code for generating a click track having a click template at each $t_i$;

program code for evaluating the fit between a series of beat candidate impulses starting at $t_0$, measured from the beginning of the digital file, with the click track, where the impulses are separated by P seconds, said program code comprising:

program code for selecting a range of values of P between $P_{min}$ and $P_{max}$;

for a given P between $P_{min}$ and $P_{max}$, program code for determining the maximum, M(P), of the cross-correlation of the click track and the beat candidate impulses for all values of $t_0$ between 0 and the given P;

program code for determining the maximum of M(P) for all values of P between $P_{min}$ and $P_{max,}$ with $P_0$ being the value of P at the maximum;

program code for selecting $P_0$ as the value of the separation of the impulses; and program code for determining peaks of the cross-correlation of the click track and the series of impulses with $P=P_0$ as a function of $t_0$ to determine downbeat candidates equal to the values of $t_0$ at the peaks.

6. A computer product for determining the location of downbeats in a musical segment stored as a digital file comprising:

a computer usable medium having computer readable program code embodied therein for directing operation of said data processing system, said computer readable program code including:

program code for determining a series of transient times, $t_i$, at times measured from the beginning of the digital file where transients occur in the musical segment;

program code for generating a click track having a click template at each $t_i$;

program code for evaluating the fit between a series of beat candidate impulses starting at $t_0$, measured from the beginning of the digital file, with the click track, where the impulses are separated by P seconds, said program code comprising:

program code for selecting a range of values of P between $P_{min}$ and $P_{max}$;

for a given P between $P_{min}$ and $P_{max}$, program code for determining the maximum, M(P), of the cross-correlation of the click track and the beat candidate impulses for all values of $t_0$ between 0 and the given P;

program code for determining the maximum of M(P) for all values of P between $P_{min}$ and $P_{max}$, with $P_0$ being the value of P at the maximum;

program code for selecting $P_0$ as the value of the separation of the impulses; and program code for determining peaks of the cross-correlation of the click track and the series of impulses with $P=P_0$ as a function of $t_0$ to determine downbeat candidates equal to the values of $t_0$ at the peaks.

7. A method of determining the location of downbeats in a musical segment stored as a digital file, said method comprising the steps of:

determining a series of transient times, $t_i$, at times measured from the beginning of the digital file where transients occur in the musical segment;

generating a click track having a click template at each $t_i$;

evaluating the fit between a series of beat candidate impulses starting at $t_0$, measured from the beginning of the digital file, with the click track, where the impulses are separated by P seconds, by performing the following steps:

selecting a plurality of values of P between $P_{min}$ and $P_{max}$;

for each of the selected plurality of values of P, determining the maximum, M(P), of the cross-correlation of the click track and the beat candidate impulses for a plurality of values of $t_0$ between 0 and the selected P;

determining the maximum of M(P) over the selected plurality of values of P, with $P_0$ being the value of P that yields the maximum M(P);

selecting $P_0$ as the value of the separation of the impulses; and determining peaks of the cross-correlation of the click track and the series of impulses with $P=P_0$ as a finction of to to determine downbeat candidates equal to the values of $t_0$ at the peaks.

* * * * *